US007614819B1

(12) United States Patent
Mirman et al.

(10) Patent No.: US 7,614,819 B1
(45) Date of Patent: Nov. 10, 2009

(54) POST ASSEMBLY AND METHOD OF ASSEMBLING THE SAME

(75) Inventors: Clifford R. Mirman, Dekalb, IL (US); Jon M. Schram, Geneva, IL (US)

(73) Assignee: Schram Management Company, Geneva, IL (US)

( * ) Notice: Subject to any disclaimer, the term of this patent is extended or adjusted under 35 U.S.C. 154(b) by 0 days.

(21) Appl. No.: 12/365,319

(22) Filed: Feb. 4, 2009

Related U.S. Application Data

(62) Division of application No. 12/134,377, filed on Jun. 6, 2008, now Pat. No. 7,524,135.

(51) Int. Cl.
*E01F 9/011* (2006.01)

(52) U.S. Cl. ..... 404/6; 404/9; 404/73; 49/49; 256/65.14; 40/607.05

(58) Field of Classification Search ..... 40/607.01, 40/607.04, 607.05, 607.08, 612; 404/6, 9, 404/73; 49/38, 41, 49; 403/46; 256/65.14
See application file for complete search history.

(56) References Cited

U.S. PATENT DOCUMENTS

| | | | | |
|---|---|---|---|---|
| 2,719,688 | A | 10/1955 | Seifert | |
| 3,119,588 | A | 1/1964 | Keats | |
| 3,417,508 | A * | 12/1968 | Sprung | 49/35 |
| 3,863,900 | A * | 2/1975 | Dagiel et al. | 256/59 |
| 5,186,197 | A | 2/1993 | Lavine | |
| 5,287,869 | A | 2/1994 | Wu | |
| 5,502,910 | A | 4/1996 | Lucchesi | |
| 5,625,988 | A | 5/1997 | Killick | |
| 6,155,744 | A | 12/2000 | Namanny | |
| 6,435,760 | B1 | 8/2002 | Pettesch | |
| 6,554,257 | B1 * | 4/2003 | Kenton | 256/24 |

(Continued)

FOREIGN PATENT DOCUMENTS

| | | |
|---|---|---|
| DE | 2513275 | 10/1976 |

(Continued)

OTHER PUBLICATIONS

International Search Report and Written Opinion dated Jun. 18, 2009 in corresponding PCT Application No. PCT/ US2009/040743.

*Primary Examiner*—Gary S Hartmann
(74) *Attorney, Agent, or Firm*—Wildman, Harrold, Allen & Dixon LLP

(57) ABSTRACT

A post assembly having a first post member, a second post member positioned within the first post member, and a sleeve member installed in the ground. The first and second post members are insertable into the sleeve member and the second post member is rotatable relative to the first post member and the sleeve member to inhibit separation of the first post member and the second post member from the ground sleeve. The first post member includes a first passage, the second post member includes a second passage having a first section and a second section, and the sleeve member includes a latch pin that travels along the first and second passages. When the latch pin is in a particular position within the first and second passages, removal of the first post member and the second post member from the sleeve member is inhibited.

7 Claims, 8 Drawing Sheets

U.S. PATENT DOCUMENTS

| | | | | |
|---|---|---|---|---|
| 6,719,484 | B1 | 4/2004 | Johnson | |
| 7,472,891 | B2 * | 1/2009 | Schram et al. | 256/65.14 |
| 7,524,135 | B1 * | 4/2009 | Mirman et al. | 404/6 |
| 2006/0204327 | A1 | 9/2006 | Phelan | |
| 2007/0176159 | A1 | 8/2007 | Schram et al. | |
| 2009/0080971 | A1 * | 3/2009 | Schram et al. | 404/6 |

FOREIGN PATENT DOCUMENTS

| | | | |
|---|---|---|---|
| GB | 2392699 | A | 3/2004 |

* cited by examiner

POST ASSEMBLY AND METHOD OF ASSEMBLING THE SAME

CROSS-REFERENCE TO RELATED APPLICATIONS

This application is a divisional of prior U.S. patent application Ser. No. 12/134,377, filed Jun. 6, 2008.

FIELD OF THE INVENTION

This invention relates generally to post assemblies and methods of assembling post assemblies.

SUMMARY

In one example, a post assembly is provided and includes a first post member including a first post wall forming a first post cavity, the first post wall having a first passage. The post assembly also including a second post member at least partially positioned within the first post cavity, the second post member including a generally cylindrical second post wall having a second passage including a first section extending generally longitudinally along the second post wall and a second section intersecting the first section. The post assembly further including a sleeve member including a sleeve wall forming a sleeve cavity and a latch pin attached to the sleeve wall and extending into the sleeve cavity, the sleeve member is adapted to receive the first post member and the second post member in the sleeve cavity such that the latch pin travels through both the first and second passages, wherein the second post member is rotatable relative to the first post member and the sleeve member to selectively inhibit separation of the first post member and the second post member from the sleeve member.

In another example, a method of installing a post assembly is provided and includes the steps of installing a sleeve member in ground, the sleeve member including a sleeve wall forming a sleeve cavity and a latch pin attached to the sleeve wall and extending into the sleeve cavity, positioning a second post member within a first post member such that a first section of a passage formed in a post wall of the second post member is generally aligned with a passage formed in a post wall of the first post member, inserting the first post member and the second post member into the sleeve cavity such that the latch pin travels through the passage of the first post member and the first section of the passage of the second post member, and rotating the second post member within the first post member such that the latch pin travels through a second section of the passage formed in the post wall of the second post member, the second section of the passage extending transverse to the first section, wherein separation of the first post member and the second post member from the sleeve member is inhibited when the latch pin is positioned within the second section of the passage formed in the post wall of the second post member.

In yet other examples, a hoop bollard assembly is provided and includes a generally U-shaped post member including a first post wall forming a first post cavity having a generally circular cross-section throughout, the generally U-shaped post member having a first end and a second end, the first post wall having a passage formed therein at the first end of the generally U-shaped post member. The hoop bollard assembly also including a locking post including a generally cylindrical locking post wall forming a locking post cavity, the first end of the generally U-shaped post member adapted to receive the locking post such that the locking post is rotatable within the generally U-shaped post member, the locking post wall having a locking passage comprising a first section extending generally longitudinally along the locking post wall and a second section intersecting the first section and extending generally perpendicular to the first section. The hoop bollard assembly further including a sleeve member including a generally cylindrical sleeve wall forming a sleeve cavity and a latch pin attached to the sleeve wall and extending into the sleeve cavity, the sleeve member being adapted to receive the locking post and the first end of the generally U-shaped post member such that the latch pin travels through the passage in the first end of the generally U-shaped post member and the locking passage of the locking post.

Figure 1:
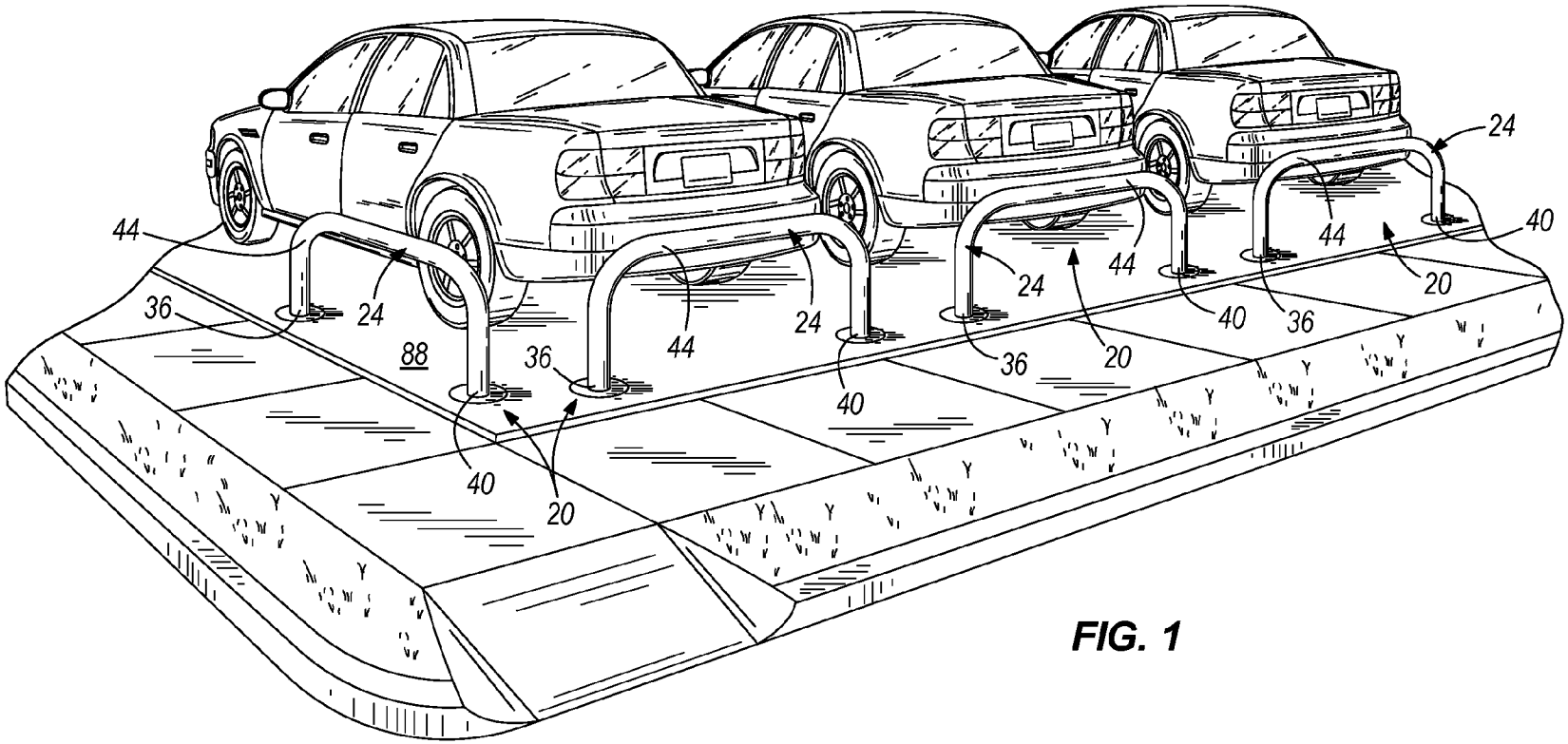
FIG. 1 is a perspective view of a plurality of exemplary post assemblies. The exemplary post assemblies are illustrated as hoop bollard assemblies.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION

Referring to FIG. 1, a plurality of exemplary post assemblies 20 are illustrated in an exemplary environment. In this exemplary construction, the post assemblies 20 consist of a plurality of hoop bollard assemblies 20. While hoop bollard assemblies 20 are illustrated in FIGS. 1-11 and described herein, the present invention can relate to other types of post assemblies (described later herein) and still be within the spirit and scope of the present invention.

With continued reference to FIG. 1 and further reference to FIG. 2, each of the illustrated hoop bollard assemblies 20 is substantially identical and, therefore, only one hoop bollard assembly 20 will be described herein. The hoop bollard assembly 20 includes a first post member or hoop bollard 24, a second post member 28, and a ground sleeve 32. The hoop bollard 24 is generally U-shaped and includes a first end 36 and a second end 40. The hoop bollard 24 includes a post wall 44 forming a cavity 48 and is, in this example, generally circular in cross-section and generally cylindrical in shape. A passage 52 is formed in the wall 44 at both the first and second ends 36, 40 and is adapted to receive a latch pin 56, which is discussed in more detail below. In the example shown, the passage 52 is cut all the way through the wall 44. However, the passage 52 could also be cut only partially through the width of the wall 44 to form a channel that would receive the latch pin 56 and allow the latch pin 56 to travel through the passage 52.

Figure 2:
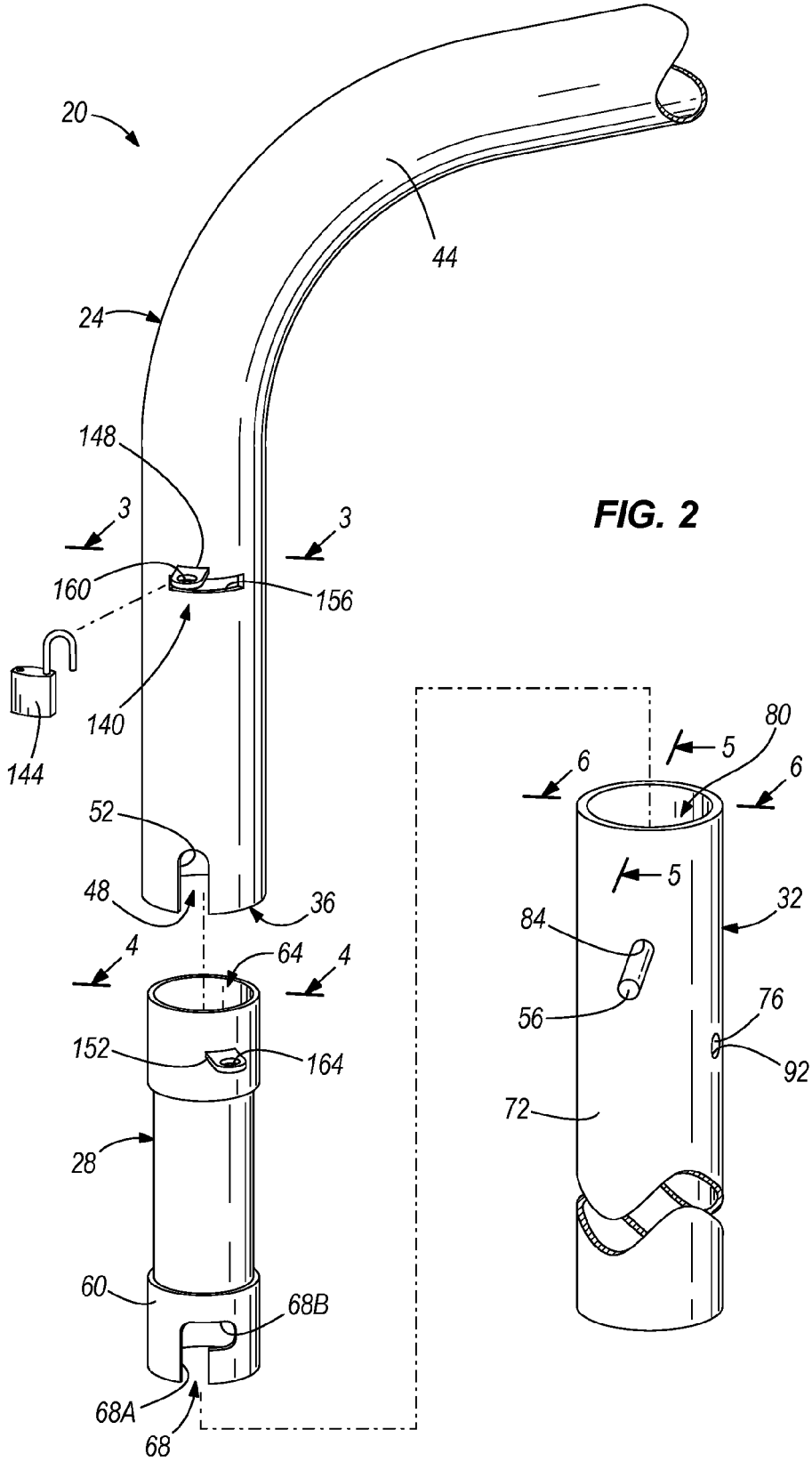
FIG. 2 is an exploded view of a portion of one of the post assemblies shown in FIG. 1.
Figure 3:
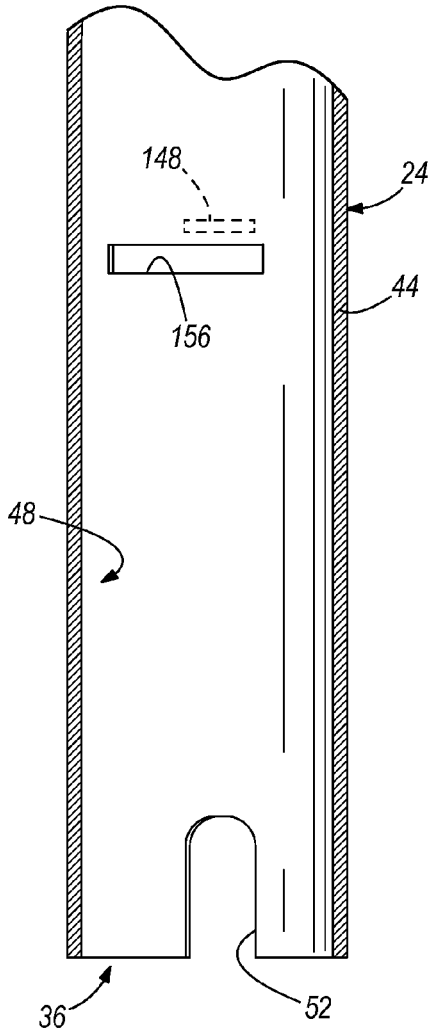
FIG. 3 is a partial cross-sectional view of a first post taken across line 3-3 in FIG. 2.

In the example shown and with particular reference to FIGS. 2 and 3, the passage 52 begins at one end of the wall 44 and extends longitudinally along the wall 44. In other examples, the passage 52 may have a different configuration such as, for example, multiple intersecting sections that are configured non-linearly with respect to each other.

In one example, the wall 44 is galvanized, stainless steel with a diameter of 76 millimeters (mm). The overall height of the hoop bollard 24 is 500 mm and overall length is 1500 mm. However, the wall 44 can be made of other appropriate materials and the overall dimensions of the hoop bollard 24 may differ depending on the application thereof.

Figure 4:
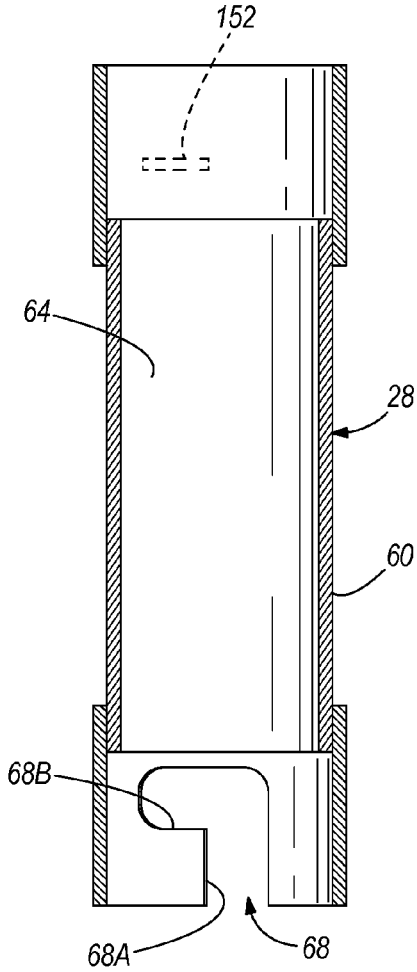
FIG. 4. is a cross-sectional view of a second post taken across line 4-4 in FIG. 2.

Referring now to FIGS. 2 and 4, the second post member 28 includes a post wall 60 forming a second post cavity 64 and is, in this example, generally circular in cross-section and generally cylindrical in shape. A second passage 68 is formed in the wall 60 and is adapted to receive the latch pin 56, which is discussed in more detail below. In the example shown, the second passage 68 is cut all the way through the wall 60. However, the second passage 68 could also be cut only partially through the width of the wall 60 to form a channel that would receive the latch pin 56 and allow the latch pin 56 to travel through the second passage 68.

In the illustrated example, the second passage 68 includes a first section 68A and a second section 68B. The first section 68A begins at one end of the wall 60 and extends longitudinally along the wall 60. The second section 68B intersects the first section 68A, begins at the end of the first section 68A, and extends generally crosswise or perpendicular to the first section 68A. In this example, the second section 68B extends transverse to the first section 68A.

Figure 6:
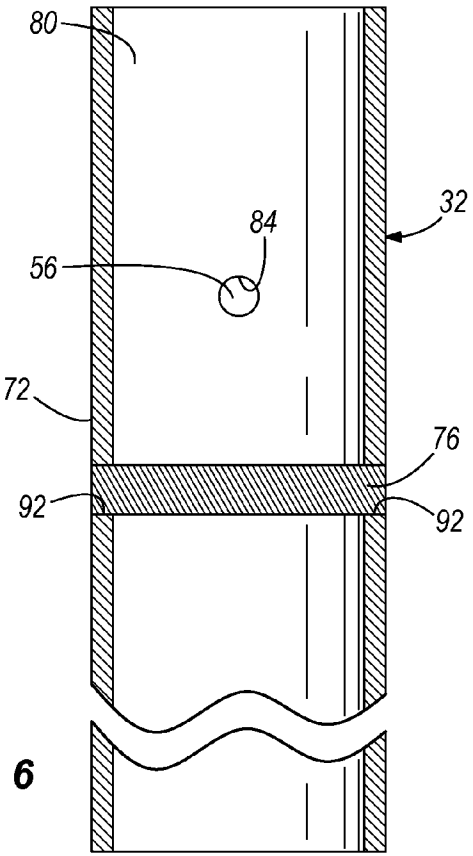
FIG. 6 is a cross-sectional view of the ground sleeve taken across line 6-6 in FIG. 2.
Figure 5:
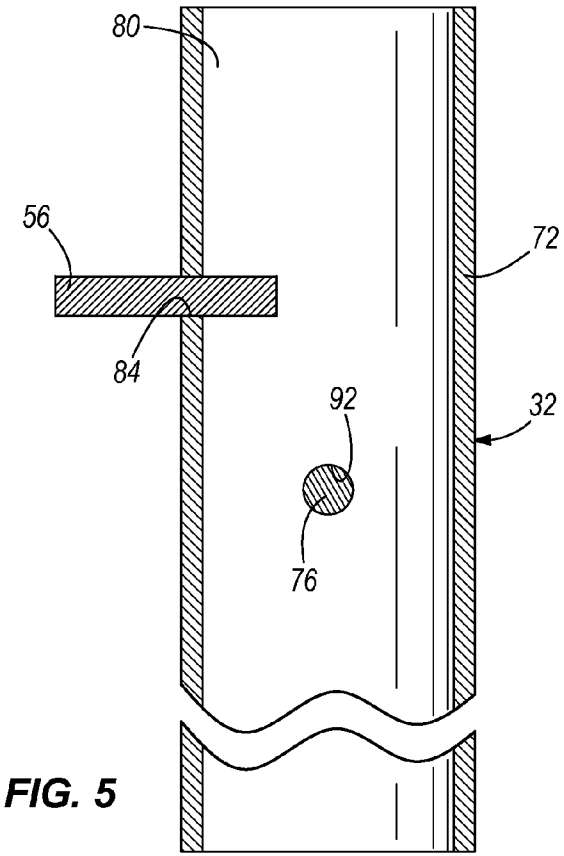
FIG. 5 is a cross-sectional view of a ground sleeve taken across line 5-5 in FIG. 2.

Referring to FIGS. 2, 5, and 6, the ground sleeve 32 has a sleeve wall 72, a latch pin 56, and a stop bar 76. The sleeve wall 72 is generally circular in cross-section, generally cylindrical throughout its length, and forms a sleeve cavity 80 that is dimensioned to receive the hoop bollard 24 and second post member 28 therein.

The latch pin 56 is positioned through a hole 84 in the sleeve wall 72 and is welded in place or otherwise secured in hole 84. The latch pin 56 is positioned such that one end extends into the sleeve cavity 80 and the opposite end extends from the outside surface of the sleeve wall 72. The portion of the latch pin 56 that extends into the sleeve cavity 80 is positioned such that it will travel through the passages 52, 68 in the hoop bollard 24 and the second post member 28 when the hoop bollard 24 and the second post member 28 are inserted into the ground sleeve 32, as discussed in more detail below. The portion of the latch pin 56 that extends outside of the sleeve wall 72 prevents movement of the ground sleeve 32 when the ground sleeve 32 is installed in the ground 88. Alternatively, the latch pin 56 could also be positioned such that one end extends into the cavity 80 and the opposite end is generally flush with the outer surface of the sleeve wall 72.

The stop bar 76 is positioned through a set of holes 92 in the sleeve wall 72, which are aligned on opposite sides of the sleeve wall 72, such that the stop bar 76 extends across the sleeve cavity 80 and is welded, press-fit in the holes 92, or otherwise held in place. The stop bar 76 will prevent the hoop bollard 24 from traveling too far into the ground sleeve 32 in the event that the latch pin 56 breaks or for some other reason does not stop the downward travel of the hoop bollard 24. Alternatively, the stop bar 76 could be positioned through a single hole in the sleeve wall 72 and extend into cavity 80, much like the latch pin 56, or could be removed from the ground sleeve 32. Alternatively, the stop bar 76 could have a length that is greater than the outer diameter of the sleeve wall 72, thereby extending across cavity 80 and outside the outer surface of the sleeve wall 72, to inhibit movement of the ground sleeve 32 when the ground sleeve 32 is installed in the ground 88.

In one example, the ground sleeve wall 72 is ERW pipe that is made from hot dipped galvanized schedule steel that has a minimum yield strength of 46,000 psi when tested using ASTM A500. The ground sleeve wall 72 has an outer diameter of 4 inches, an inner diameter of 3 inches, and a length of 24 inches after galvanizing. In addition, in this example, the latch pin 56 is a 0.625 inch diameter bar of 1018 steel, has a length of 2.75 inches, and is positioned such that 2 inches of the latch pin 56 extends outside of the sleeve wall 72 and the stop bar 76 is a 0.625 inch diameter bar of 1018 steel, has a length of 4 inches, and is positioned such that the ends of the stop bar 76 are generally flush with the outer surface of the sleeve wall 72.

Figure 7:
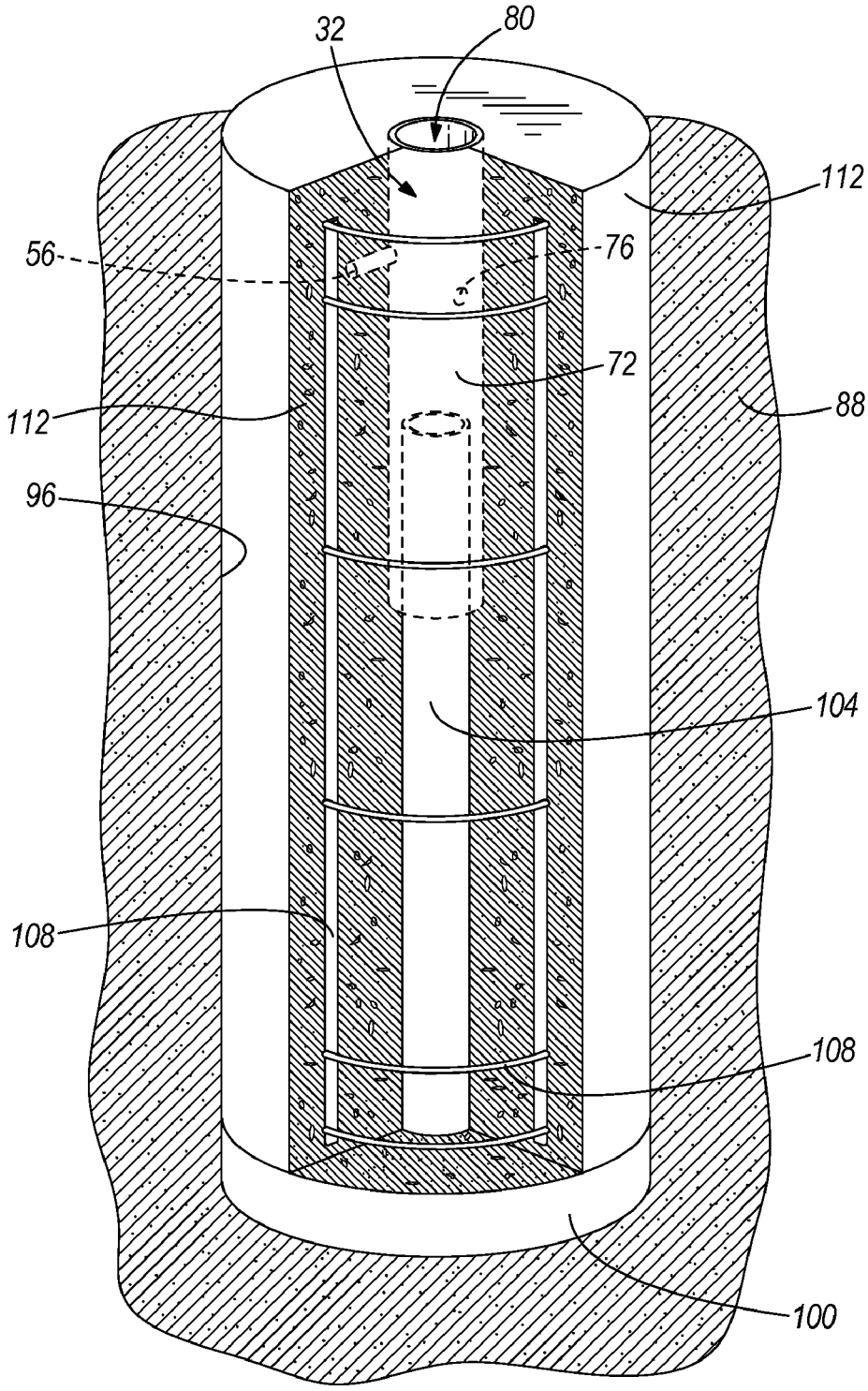
FIG. 7 is a perspective view of an exemplary installation of the ground sleeve.

In operation, the ground sleeve 32 is first installed in the ground 88. Referring to FIG. 7, in one example, a hole 96 is dug in the ground 88 that is approximately 18 inches in diameter and 45 inches deep. The bottom of the hole 96 is filled with approximately 3 inches of angular rock, gravel, or similar material to provide a drain base 100. A drain pipe 104 is placed in the center of the hole 96 against the drain base 100 to provide drainage from the ground sleeve 32. In this example, the drain pipe 104 is a 2.5 inch diameter schedule 40 polyvinyl chloride (PVC) pipe that is 24 inches long. The ground sleeve 32 is placed over the drain pipe 104 such that the top of the ground sleeve 32 is level with the grade of the ground 88. If desired, rebar 108 can be placed around the drain pipe 104 and ground sleeve 32 to provide extra strength. The hole 96 is then filled with concrete 112, such that the top of the concrete 112 is level with the grade of the ground 88, to secure the ground sleeve 32. As mentioned above, the portion of the latch pin 56 that extends outside the ground sleeve wall 72 will be secured in the concrete 112 and will prevent the ground sleeve 32 from rotating or moving vertically within the concrete 112.

Figure 8:
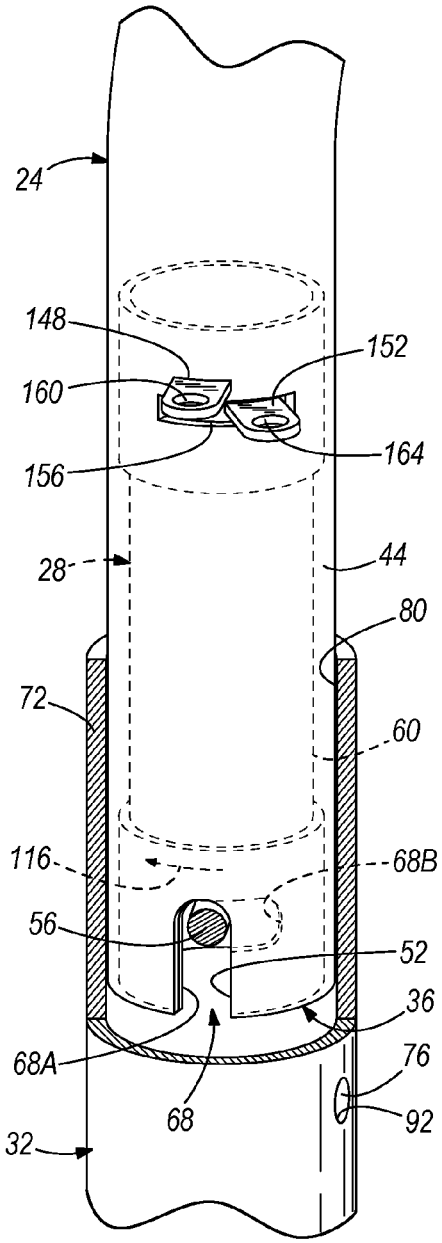
FIG. 8 is a partially broken perspective view of a portion of the post assembly shown in FIG. 1, shown with a portion of the ground sleeve removed and the second post in an unsecured position.

Referring now to FIG. 8, the hoop bollard 24 and second post member 28 can be inserted into the ground sleeve cavity 80 once the ground sleeve 32 is installed in the ground 88. To insert the hoop bollard 24 and second post member 28 into the ground sleeve cavity 80, the hoop bollard 24 and second post member 28 are positioned above the ground sleeve 32, the second post member 28 is positioned in the unsecured position such that the first passage 52 is generally aligned with the first section 68A of the second passage 68, and the generally aligned first passage 52 and first section 68A are aligned with the latch pin 56. Then, the hoop bollard 24 and the second post member 28 are inserted into the ground sleeve cavity 80 and pushed down so that the latch pin 56 travels along the first passage 52 and the first section 68A of the second passage 68.

Figure 9:
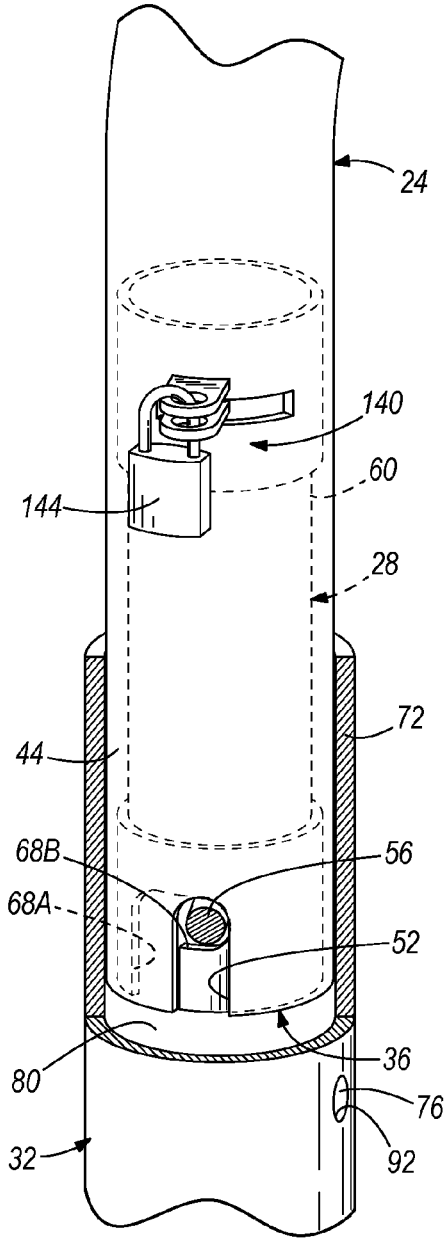
FIG. 9 is a partially broken perspective view of the post assembly similar to FIG. 8, shown with the second post in a secured position.

Referring now to FIG. 9, once the latch pin 56 reaches the end of the first section 68A, the second post member 28 is rotated relative to the hoop bollard 24 and the ground sleeve 32 in a direction identified by arrow 116 in FIG. 8 so that the latch pin 56 travels along the second section 68B of the second passage 68 away from the first section 68A. The position of the second post member 28 shown in FIG. 9 is the secured position. In the secured position, a portion of the second post wall 60 is positioned below the latch pin 56, thereby preventing the second post member 28 and the hoop bollard 24 from being separated or removed from the ground sleeve 32 with a simple straight upward pulling motion. This gives the appearance that the hoop bollard 24 cannot be removed, even in the absence of an actual locking device (described in more detail below), which would lock the hoop bollard 24 in place and prevent substantial movement of the hoop bollard 24 relative to the ground sleeve 32.

Once the hoop bollard 24 is fully inserted as described above, the hoop bollard 24 cannot be removed by simply pulling upward on the hoop bollard 24. Rather, the second post member 28 must be rotated in a second direction opposite to the arrow 116 shown in FIG. 8 to re-align the first passage 52 and the first section 68A of the second passage 68, and the hoop bollard 24 and second post member 28 must be pulled upward to remove the hoop bollard 24 from the ground sleeve 32. This rotation of the second post member 28 from the secured position (see FIG. 9) to the unsecured position (see FIG. 8) in order to remove the hoop bollard 24 from the ground sleeve 32 may prevent the hoop bollard 24 from being removed by unauthorized persons. Generally, if someone unfamiliar with the hoop bollard 24 were to try and remove it, they would do so by pulling up on the hoop bollard 24. If this were to occur, the latch pin 56 would engage the second post wall 60 and prevent further upward movement of the hoop bollard 24. Unless the person was familiar with the hoop bollard 24, they would not know that the hoop bollard 24 can be removed by rotating the second post member 28 and would think that the hoop bollard 24 was permanent.

While the illustrated example of the hoop bollard assembly 20 includes a second post member 28 received within both ends 36, 40 of the first post member 24, it should be understood that the hoop bollard assembly 20 may include a single second post member 28 received in only one end of the first post member 24. The other end of the first post member 24 can be connected to the ground in another manner such as, for example, fasteners, anchor bolts, etc., or merely placed and not secured within a ground sleeve. A single second post member 28 is sufficient to prevent the second post member 28 and the hoop bollard 24 from being separated or removed from the ground sleeve 32 with a simple straight upward pulling motion.

Figure 11:
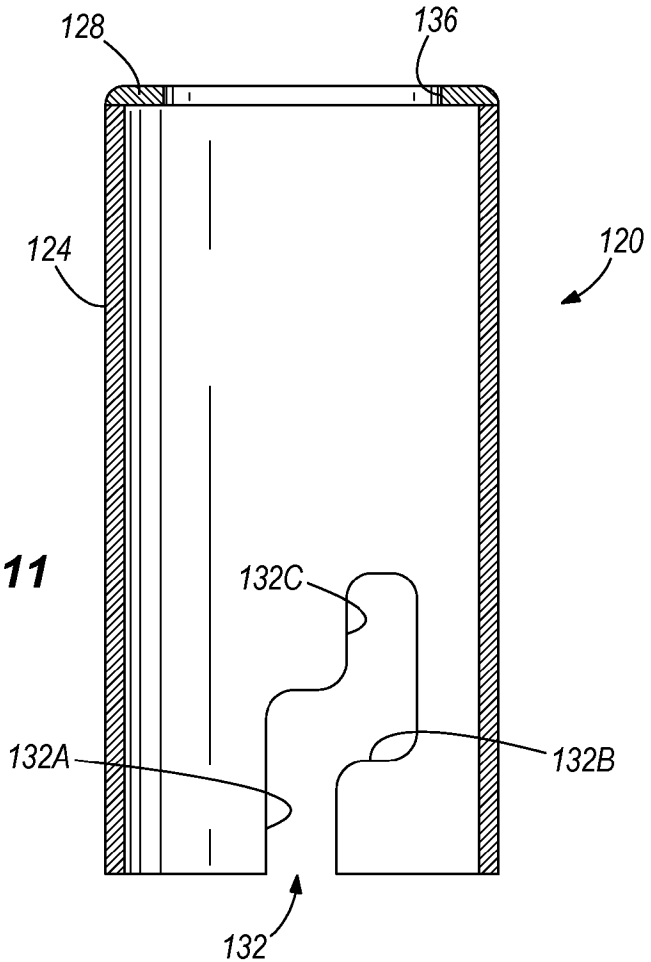
FIG. 11 is a cross-sectional view of the ground sleeve cap taken across line 11-11 in FIG. 10.
Figure 10:
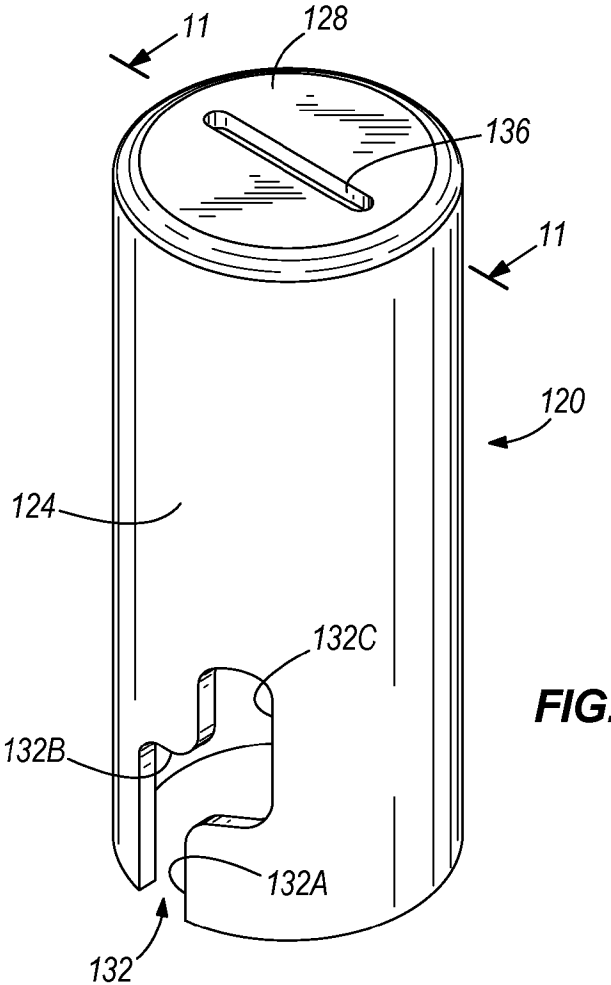
FIG. 10 is a perspective view of an exemplary ground sleeve cap.

In another example, the hoop bollard assembly 20 may also include a ground sleeve cover 120 that would be used to cover the ground sleeve 32 when the hoop bollard 24 is not installed. Referring to FIGS. 10 and 11, an exemplary ground sleeve cover 120 has a generally cylindrical wall 124 and an end cap 128. In the illustrated example, a cover passage 132 is formed in the wall 124. The cover passage 132 includes three sections 132A, 132B, 132C and is adapted to receive the latch pin 56 of the ground sleeve 32. The first section 132A begins at one end of the wall 124 and extends longitudinally along the wall 124. The second section 132B intersects the first section 132A, begins at the end of the first section 132A, and extends, in this example, transverse to the first section 132A. The third section 132C intersects the second section 132B, begins at the end of the second section 132B, and also extends longitudinally along the cover wall 124. The stair-step type configuration of the various sections of the cover passage 132 prevent the ground sleeve cover 120 from being removed from the ground sleeve 32 with a simple straight upward pulling motion, which gives the appearance that the ground sleeve cover 120 cannot be removed.

Alternatively, the cover passage 132 can be similar to the second passage 68 illustrated in FIGS. 2, 4, 8, and 9 which includes two sections 132A, 132B. This configuration will also prevent the ground sleeve cover 120 from being removed from the ground sleeve 32 with a simple straight upward pulling motion, giving the appearance that the ground sleeve cover 120 cannot be removed.

The end cap 128 covers the end of the cover wall 124 opposite the cover passage 132. The end cap 128 is placed flush with the end of the cover wall 124 and the end cap 128 is butt welded to the cover wall 124 or secured to the wall 124 by some other well known means. Alternatively, the end cap 128 can also be integrally formed as part of the cover wall 124. A slot 136 is formed in the end cap 128 and is adapted to receive a key or other tool to assist in inserting and removing the ground sleeve cover 120.

In one example, the ground sleeve cover wall 124 is ERW pipe that is made from hot dipped galvanized schedule 40 steel and has a minimum yield strength of 46,000 psi when tested using ASTM A500. The ground sleeve cover wall 124 has an outer diameter of 3.5 inches, an inner diameter of 3 inches, and a length of 8 inches after galvanizing. In addition, in this example, the end cap 128 is a generally circular, hot dip galvanized, 0.25 inch thick steel plate that has roughly the same outer diameter as the cover wall 124 and the slot 136 extends across the end cap 128 and is 0.25 inches wide and 2.25 inches long.

To install the ground sleeve cover 120, the ground sleeve cover 120 is positioned above the ground sleeve 32 such that the first section 132A of the cover passage 132 is aligned with the latch pin 56. The ground sleeve cover 120 is then inserted into the ground sleeve 32 and pushed down so that the latch pin 56 travels along the first section 132A. Once the latch pin 56 reaches the end of the first section 132A, the ground sleeve cover 120 is rotated so that the latch pin 56 travels along the second section 132B. Once the latch pin 56 reaches the end of the second section 132B, the ground sleeve cover 120 is then pushed down again so that the latch pin 56 travels along the third section 132C. The ground sleeve cover 120 is pushed down until the latch pin 56 contacts the end of the third section 132C or the bottom of the ground sleeve cover 120 contacts the stop bar 76, depending on the exact dimensions and the installation of the cover 120 and ground sleeve 32.

To remove the ground sleeve cover 120, a key or other tool is inserted into the slot 136 and the ground sleeve cover 120 is lifted so that the latch pin 56 travels along the third section 132C. The ground sleeve cover 120 is then rotated so that the latch pin 56 travels along the second section 132B and lifted again so that the latch pin 56 travels along the first section 132A, at which point the ground sleeve cover 120 can be removed from the ground sleeve 32.

Referring to FIGS. 2-4, 8, and 9, the hoop bollard assembly 20 can also include a lock assembly 140 to prevent rotation of the second post member 28 with the hoop bollard 24 and, ultimately, to prevent removal of the hoop bollard 24 and second post member 28 from the ground sleeve 32. In one example, the lock assembly 140 includes a locking device 144, a first tab 148 mounted to an outer surface of the hoop bollard 24, a second tab 152 mounted to an outer surface of the second post member 28, a slot 156 defined in the post wall 44 receiving the second tab 152 and allowing the second tab 152 to extend from the exterior of the second post wall 60, through the slot 156, and externally of the hoop bollard 24. In the illustrated example, the locking device 144 is a padlock. In other examples, the locking device 144 may be other types of locking devices such as cable locks, tamper proof screws, etc. The first tab 148 includes a first hole 160 and the second tab 152 includes a second hole 164. The slot 156 is sufficiently dimensioned to allow the second tab 152 to rotate with the second post member 28 between the secured and unsecured positions. When the second post member 28 is in the unsecured position (see FIG. 8), the first tab 148 and second tab 152, and thereby the first hole 160 and second hole 164, are not aligned. When the second post member 28 is positioned in the secured position, the first and second tabs 148, 152, and thereby the first and second holes 160, 164, are aligned. When the first and second holes 160, 164 are aligned, the locking device 144 is insertable through the aligned holes 160, 164 and locked to prevent a person from rotating the second post member 28 out of the secured position and removing the hoop bollard 24 from the ground sleeve 32.

It should be understood that the second post member 28 can be rotated between the secured and unsecured positions in a variety of manners. In one example, a person may rotate the second post member 28 by grasping the second tab 152 and moving the second tab 152 in the slot 156, thereby rotating the second post member 28. In another example, the hoop bollard 24 can include a window or opening allowing access to a portion of the second post member 28 so that a person can directly engage the second post wall 60 and rotate the second post member 28. Other exemplary manners for rotating the second post member 28 will be apparent to those skilled in the art and are within the intended scope of the present invention.

Figure 12:
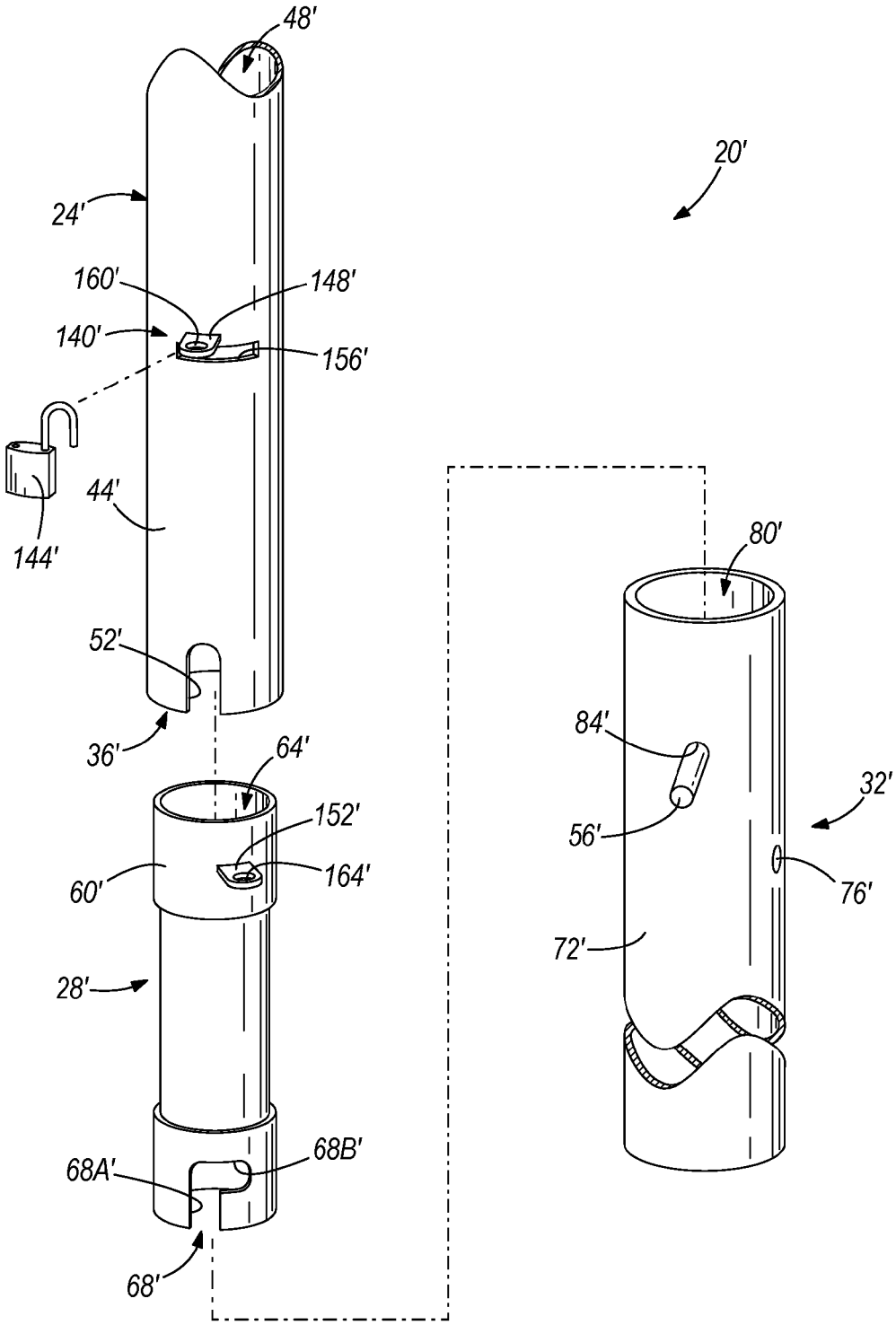
FIG. 12 is an exploded view of another exemplary post assembly.

Referring to FIG. 12, an alternative post assembly 20' is illustrated. Components of the post assembly 20' illustrated in FIG. 12 that are similar to components of the post assembly 20 illustrated in FIGS. 1-11 are identified with the same reference number and an "'". Similarly to the post assembly 20 shown in FIGS. 1-11, the post assembly 20' illustrated in FIG. 12 includes a first post member 24', a second post member 28', and a ground sleeve 32'. However, the first post member 24' can be a variety of other types of first post members 24', different than a hoop bollard. For example, the first post members 24' can be a bench post, a fence post, a straight bollard, a light post, a parking meter post, a mail box post, a basketball post, a tennis net post, a volleyball net post, a badminton net post, a flag poll, a public park grill post, picnic table legs, a dock or pier post for tying-up boats or other water recreational vehicles, a traffic post, a street sign post, an informational sign post, a traffic-light post, a bicycle rack post, a swimming pool ladder post, a playground equipment post, or any other apparatus that is removable and locking of the device is desired while the apparatus is installed. These examples are not meant to be exhaustive and other types of posts or apparatuses will be apparent to those skilled in the art and are within the intended scope of the present invention.

The foregoing description of the preferred embodiment of the invention has been presented for purposes of illustration and description, and is not intended to be exhaustive or to limit the invention to the precise form disclosed. The descriptions were selected to best explain the principles of the invention and their practical application to enable other skills in the art to best utilize the invention in various embodiments and various modifications as are suited to the particular use contemplated. Although particular constructions of the present invention have been shown and described, other alternative constructions will be apparent to those skilled in the art and are within the intended scope of the present invention. It is intended that the scope of the invention not be limited by the specification, but be defined by the claims set forth below.

What is claimed is:

1. A method of installing a post assembly, comprising the steps of:

installing a sleeve member in ground, the sleeve member comprising a sleeve wall forming a sleeve cavity and a latch pin attached to the sleeve wall and extending into the sleeve cavity;

positioning a second post member within a first post member such that a first section of a passage formed in a post wall of the second post member is generally aligned with a passage formed in a post wall of the first post member;

inserting the first post member and the second post member into the sleeve cavity such that the latch pin travels through the passage of the first post member and the first section of the passage of the second post member; and rotating the second post member within the first post member such that the latch pin travels through a second section of the passage formed in the post wall of the second post member, the second section of the passage extending transverse to the first section;

wherein separation of the first post member and the second post member from the sleeve member is inhibited when the latch pin is positioned within the second section of the passage formed in the post wall of the second post member.

2. The method of claim 1, wherein the sleeve wall, the post wall of the first post member, and the post wall of the second post member are generally cylindrical.

3. The method of claim 1, wherein the second section of the passage formed in the second post member extends generally perpendicular to the first section of the passage formed in the second post member.

4. The method of claim 1, wherein the first post member is a hoop bollard.

5. The method of claim 1, further comprising the step of securing the second post member to the first post member to prevent rotation of the second post member relative to the first post member.

6. The method of claim 5, wherein the second post member is secured to the first post member with a locking device.

7. The method of claim 6, wherein securing the second post member to the first post member comprises the steps of aligning a first hole formed in a first tab that is connected to the first post member with a second hole that is formed in a second tab that is connected to the second post member, and inserting the locking device through the first hole and second hole.

* * * * *